United States Patent [19]

Buffum

[11] 4,363,514

[45] Dec. 14, 1982

[54] CARRIER FOR SKATES

[76] Inventor: Richard J. Buffum, 50 Carver Dr., Magalia, Calif. 95954

[21] Appl. No.: 178,999

[22] Filed: Aug. 18, 1980

[51] Int. Cl.[3] ..... B65D 71/00

[52] U.S. Cl. ..... 294/162

[58] Field of Search ..... 294/162; 280/814, 825; 12/113, 124, 120.5; 223/113, 116, 118, 119

[56] References Cited

U.S. PATENT DOCUMENTS 3,272,413 9/1966 Pfleider ..... 294/162

3,909,718 9/1975 Allsop et al. ..... 294/162

4,083,483 4/1978 Bayless ..... 294/162

*Primary Examiner*—James B. Marbert

*Attorney, Agent, or Firm*—Mark C. Jacobs

[57] ABSTRACT

A carrier for a pair of skates, such as roller skates or ice skates or the like, wherein the skates have a shoe supported on a wheeled plate, and a jump bar spaced from the bottom of the plate, the carrier including a support or carrying bar extending from a pair of upper and lower spaced flanges with an adjustable bar between the flanges for securely gripping the skates between the plate and the jump bar thereof.

7 Claims, 7 Drawing Figures

CARRIER FOR SKATES

BACKGROUND OF THE INVENTION

1. Field of the Invention

The invention relates to carriers; and, more particularly, to a carrier for a pair of skates.

2. Description of the Prior Art

There has been increased interest in skating in recent years, particularly roller skates since such affords a more economical means of transportation, especially in these environmentally conscious times. Such increased interest has also fueled interest in professional skating. Generally speaking, a professional, and, in fact, many non-professionals, must transport their skates to the location where they will skate. Since many skates are quite expensive, and rather bulky, it is desirable to transport them in a manner preventing damage thereto and facilitate carrying. For example, small carrying cases have been used in the past. Such cases are in themselves relatively bulky and expensive. Carrying straps have also been suggested which encircle the skates but such straps wear quickly and it is difficult to transport a pair of skates in this manner. Other devices have proven to be expensive and bulky, both with and without the skates.

There is a need for a carrier for a pair of skates which can be used to quickly and easily mount the skates thereto, transport them in a manner requiring little effort and is adjustable to securely mount the skates thereto. Preferably, the skates should be mounted side-by-side to reduce the bulkiness thereof.

SUMMARY OF THE INVENTION

It is an object of this invention to provide an improved carrier for a pair of skates.

It is a further object of this invention to provide such a carrier which is adjustable to skates of varying types.

It is still another object of this invention to provide a carrier which transports the skates in a side-by-side relationship.

These and other objects are preferably accomplished by providing a carrier for skates having shoes supported on a wheeled plate, and a jump bar spaced from the bottom of the plate, the carrier including a support or carrying bar extending from a pair of upper and lower spaced flanges with an adjustable bar between the flanges for securely gripping the skates between the plate and the jump bar thereof.

DESCRIPTION OF THE PREFERRED EMBODIMENT

Figure 1:
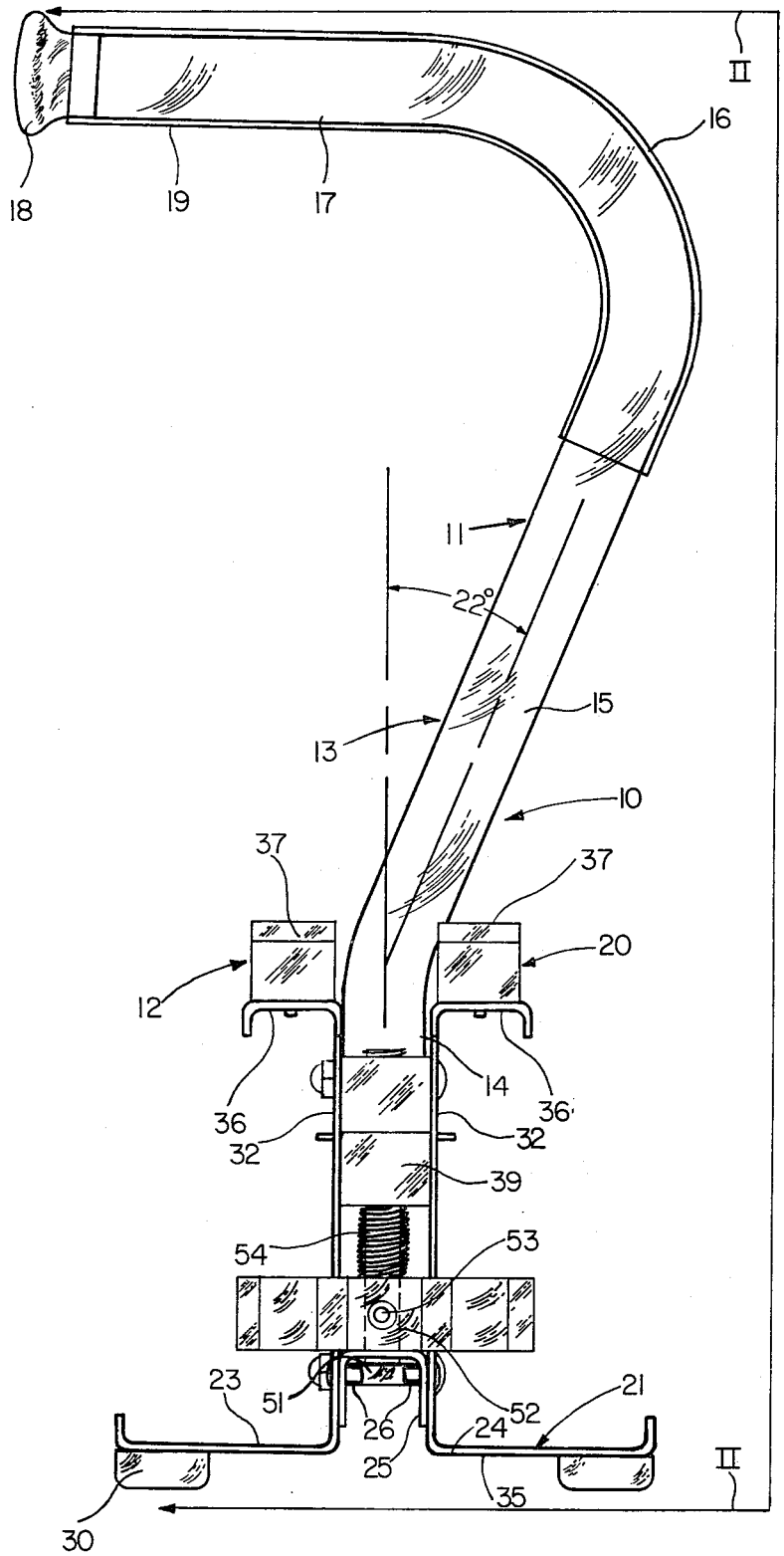
FIG. 1 is a vertical view of the carrier of the invention.

Referring now to FIG. 1 of the drawing, a carrier 10 in accordance with the invention is shown. Carrier 10 is comprised of support or carrying means 11 and skate retaining means 12. Carrying means 11 may comprise a tubular member 13 having a generally straight vertical bottom portion 14, an integral midportion 15 extending upwardly from bottom portion 14 at an angle as shown in FIG. 1, e.g. at a preferred angle of about 22°, then curving in the opposite direction, at curved portion 16, to a generally linear upper horizontal portion 17. Portion 17 may terminate in a plug or stop member 18 and may be encircled by a cushioning or abrasion-preventing member 19, such as tubular plastic, between stop member 18 and curved portion 16.

Figure 2:
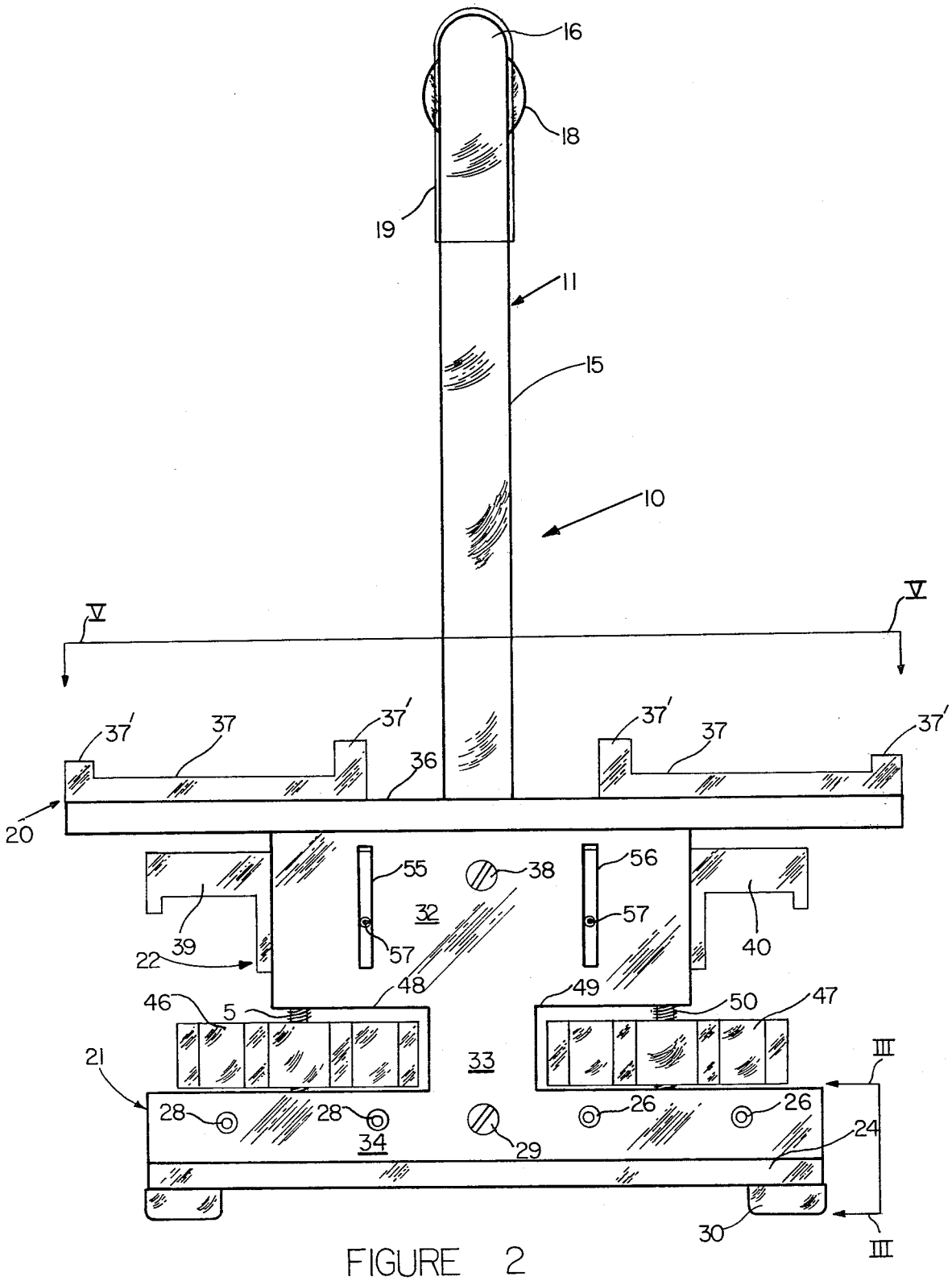
FIG. 2 is a view taken along lines II—II of FIG. 1.
Figure 3:
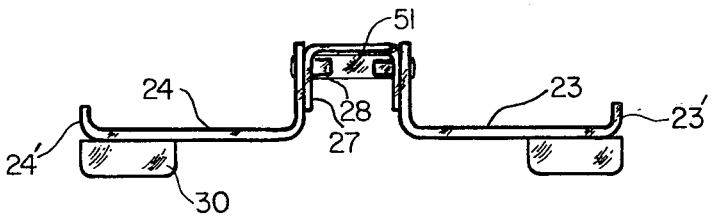
FIG. 3 is a view taken along lines III—III of FIG. 2.
Figure 4:
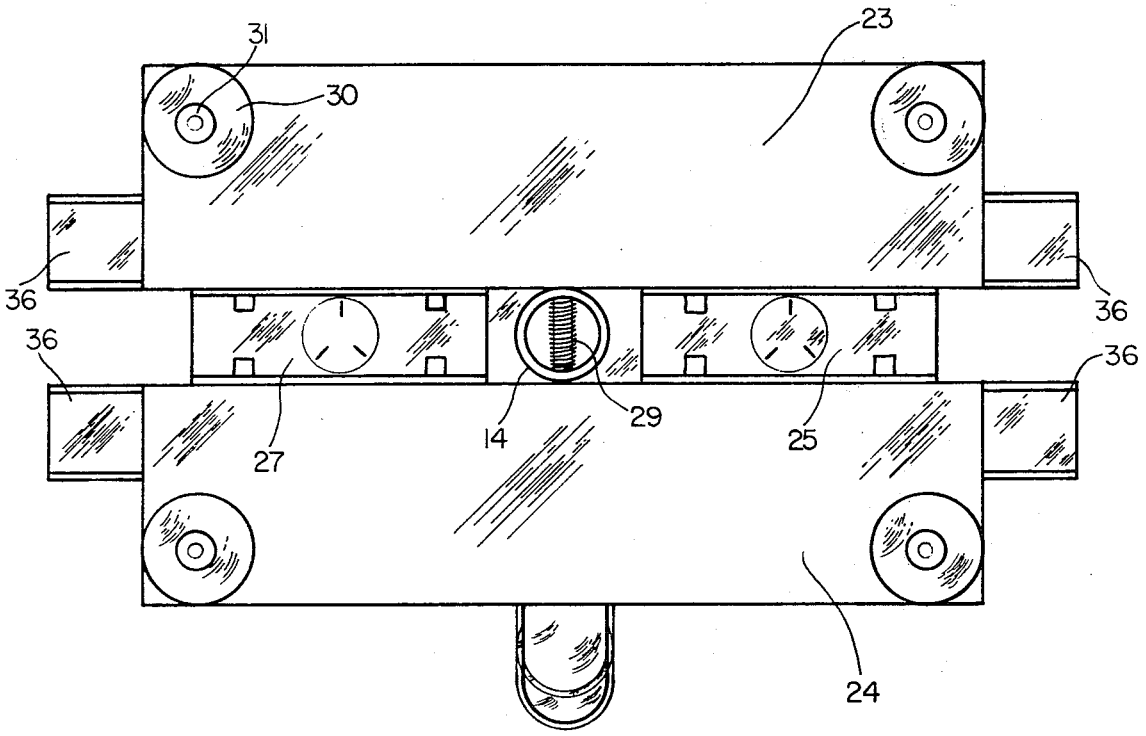
FIG. 4 is a bottom plan view of the carrier of FIG. 1.

Retaining means 12 is comprised of a pair of spaced upper and lower flange means 20,21, respectively (see also FIG. 2). Adjusting means 22 is disposed between flange means 20,21. Lower flange means 21 is fixed in position and may comprise a pair of spaced bottom plates 23,24. Each plate 23,24 may turn either upwardly or downwardly, as shown in FIG. 3 at ends 23', 24', respectively. As shown in FIG. 1, a U-shaped bracket 25 is disposed between plates 23,24. Rivets 26 or the like may be used to secure bracket 25 to plates 23,24. The view of carrier 10 in FIG. 1 in the opposite direction thereof would be a mirror image thereof as shown partly in FIG. 3 where parts have been omitted for convenience of illustration. As can be seen, bracket 27, similar to bracket 25, secures plates 23,24 together via rivets 28. Both brackets 25,27 are shown in FIG. 4 and, as can be seen, the terminal end of bottom portion 14 of tubular member 13 is secured to plates 23,24 via screw 29. A plurality of feet or cushioning pads 30 may be secured to the bottom corners of plates 23,24 as shown, by rivets 31 or the like.

Figure 5:
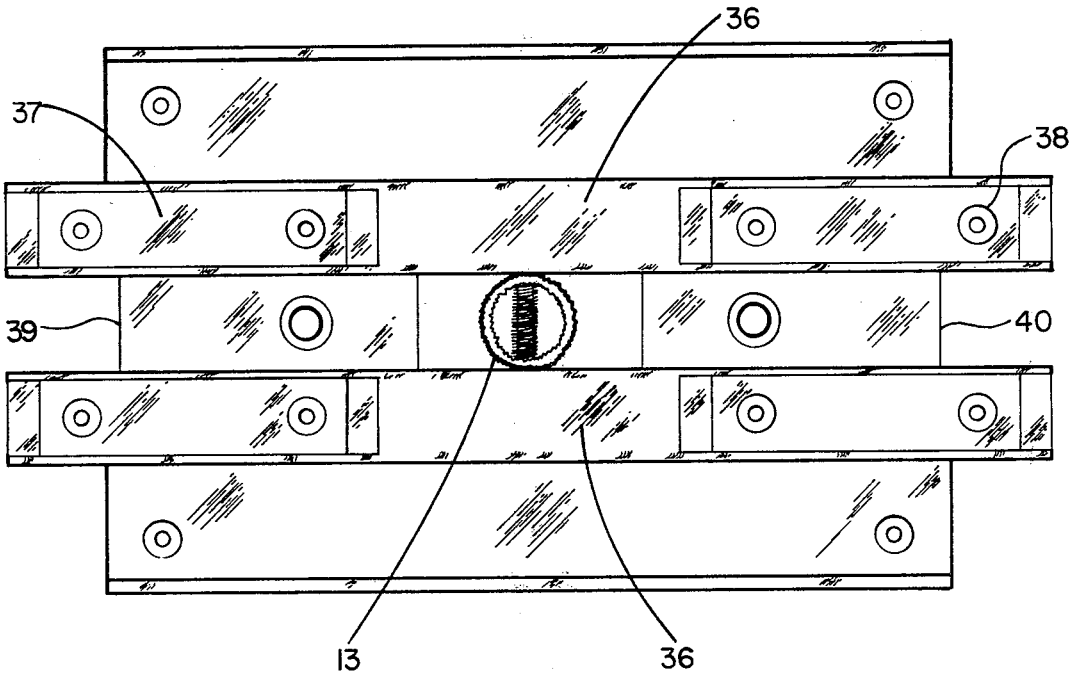
FIG. 5 is a view taken along lines V—V of FIG. 2.

As can be appreciated by comparing FIG. 1 with FIG. 2, each plate 23,24 is generally H-shaped having a vertical upper portion 32 interconnecting the bottom plate, such as plate 24 in FIG. 2. A neck portion 33 interconnects upper portion 32 with plate 24 (plate 25 is identically constructed). Plate 24 is connected to neck portion 33 at a vertical flange 34 extending upwardly from a horizontal flange 35 (see also FIG. 1). Each upper vertical portion 32 terminates at a horizontal upper flange portion 36. As shown in FIGS. 1 and 2, a plurality, such as four, of U-shaped spacer bars 37 are mounted on the upper surfaces of flange portions 36, as shown in FIG. 5, and having their horizontal portions secured thereto by rivets 38 or the like. As can be seen, tubular member 13 acts as a spacer between upper flange portions 36. As shown in FIG. 2, a screw 38 may also secure tubular member 13 to upper vertical portions 32. The upwardly extending ends of 37 are called 37'.

Figure 6:
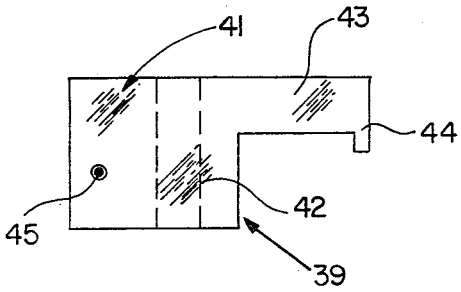
FIG. 6 is a detailed view of one component of the carrier of FIG. 1.

The adjusting means 22 will now be described. In addition to the necessary supporting structure previously described, such means 22 includes a pair of adjusting bars 39,40 (see FIGS. 1, 2 and 5) slidably mounted between portions 32. As shown in detail in FIG. 6, each bar 39,40 (only bar 39 will be described) includes a generally square portion 41 having a threaded bore 42 therethrough, an integral narrow horizontal portion 43, having a vertical lip portion 44. An opening 45 extends through square portion 41 as shown.

Referring now to FIGS. 1 and 2, a pair of thumb wheels 46,47 are provided in the areas 48,49, respectively, between portions 32,33 and 34. A threaded bolt 50 having a head 51 (see particularly FIGS. 1 and 3) extends from each U-shaped bracket 25,27, through a threaded central aperture 52 (see the dotted lines in FIG. 1), and threads through bore 42 in each bar 39,40. As seen in FIG. 1, a pin 53 extends through each wheel 46,47 engaging the threaded shaft 54 of bolt 50.

As seen in FIG. 2, each upper portion 32 includes a pair of spaced vertical slots 55,56 which slots are axially aligned with openings 45 in each bar 39,40. A pin 57 rides in each slot 55,56 fixedly secured in opening 45 in each bar 39,40 to provide proper alignment to bars 39,40 as they move up and down as will be discussed.

Figure 7:
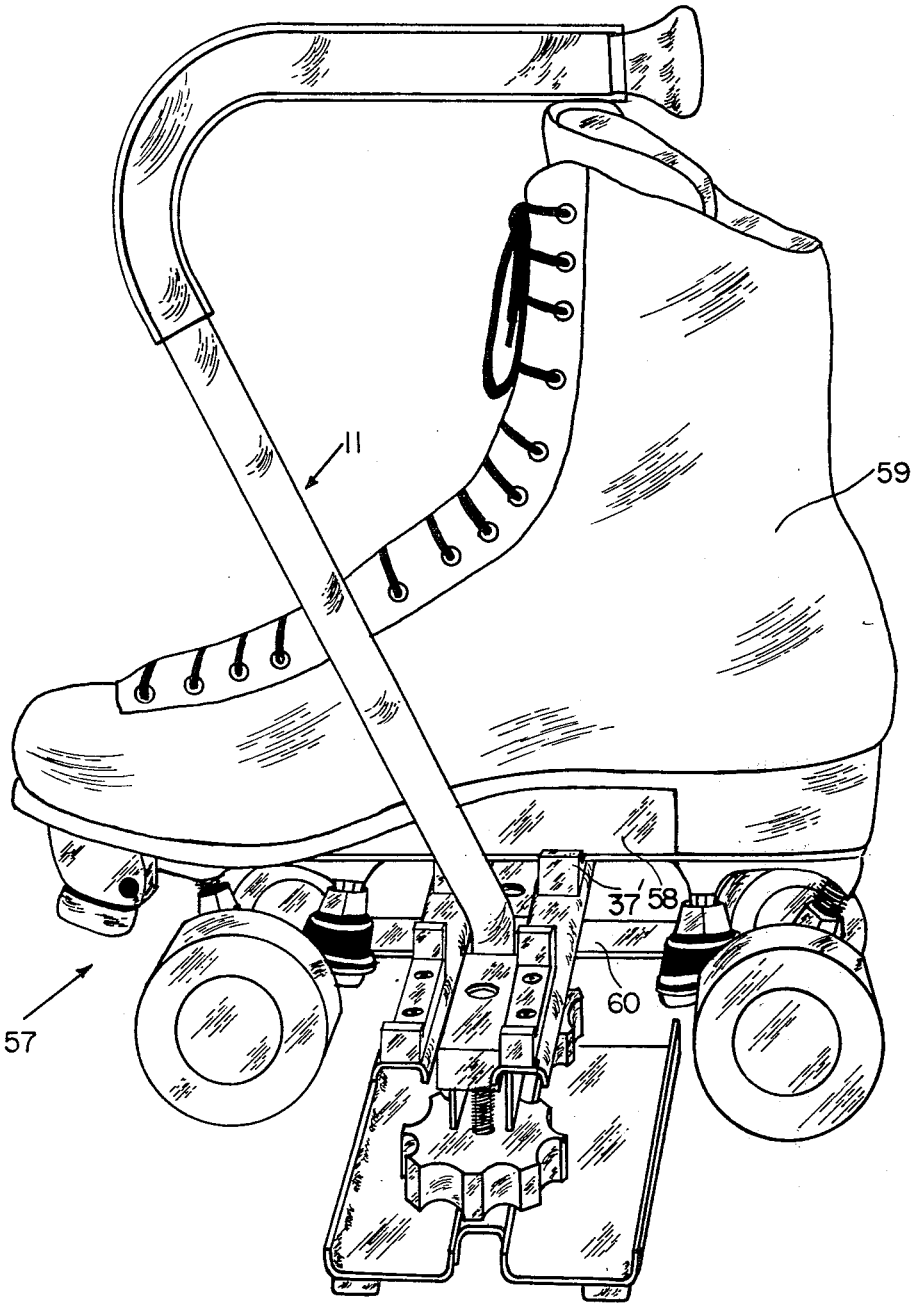
FIG. 7 is a perspective view showing the carrier of FIGS. 1 through 6 having a pair of roller skates installed thereon.

The assembly of carrier 10 to a pair of skates is illustrated in FIG. 7. Each skate 57 includes a bottom plate 58 on which the shoe 59 is mounted and a support or jump bar 60 spaced from the bottom plate 58. The ends of spaced bars 37 on flange portions 36 are inserted in the space between plate 58 and bar 60 with the bottom of plate 58 resting on the top of bar 37 between the upwardly extending ends 37' thereof (see also FIG. 2). The space between ends 37' is generally related to the width of each plate 58 and serves to keep the plate 58 aligned. Rotation of each wheel 47 moves each bar 39,40 (since wheel 47 is threaded on and secured to the threaded shaft of each bolt 50) downwardly to abut against the top side of jump bar 60 and firmly hold each skate on carrier 10, pins 57 riding in slots 55,56 to keep the bars 39,40 in alignment. It can be appreciated that merely counter rotating wheel 47 releases bars 39,40 from locking engagement with bar 60 to release each skate.

It can be seen that the skates are retained on carrier 10 in a side-by-side relationship. They can be easily carried and released when needed. The carrier 10 can be held at the handle portions 16,17. The stop member 18 will abut against the top of the shoes presenting a neat compact package which can be set on any suitable supporting surface, resting on pads 30.

It can be seen that there is described a carrier for carrying a pair of skates in a firm, secure manner providing proper support to the skates. Such a carrier can be used to carry any type of skates, ice or roller or the like, amateur or professional, where there is sufficient space between the supporting plate and jump bar (or other support members) of the skates and is quickly and easily adjusted to compensate for differences in skate dimensions to secure the same to the carrier.

It is seen that the device of this invention is operative with any skate having a reinforcing bar, termed a jump bar in the language of the trade. Skates having such bars are designated artistic skates and are employed by professionals and advanced amateurs for exhibition and dance skating. Such skates are sold in the marketplace by Snyder Skate Company of Dayton, Ohio, among others. Another purveyor of such skates is Suregrip, makers of the Classic and Century skates.

The device herein can be used by men and women for easing the burden of carrying their skates from place to place.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A carrier for supporting a pair of shoe type roller skates for carrying the same in a side-by-side horizontal relationship wherein each skate includes a pair of spaced support plates, said carrier comprising:

an elongated support member having an upper handle portion and a downwardly extending bottom portion;

skate retaining means fixedly secured to the bottom portion for retaining a pair of skates thereon in a side-by-side horizontal relationship, said retaining means including upper flange means adapted to abut against the underside of one of said support plates of each skate and adjusting means adapted to be movable against the other of said support plates of each skate to thereby securely clamp said other of said support plates between the lower surface of said upper flange means and the upper surface of said adjusting means.

2. In the carrier of claim 1 wherein said upper flange means includes a pair of spaced fixedly secured flanges separated by both the bottom portion of said support member and said adjusting means.

3. In the carrier of claim 2 including a pair of bars fixedly secured to the upper surface of each of said flanges on each side of said bottom portion, each of said bars having a generally flat horizontal portion secured to said flange and terminating at their ends in upwardly extending vertical end portions.

4. In the carrier of claim 2 wherein said adjusting means includes a pair of spacers having threaded apertures therein receiving a threaded bolt therethrough, said carrier including a bottom flange support adapted to rest on a supporting surface, said bottom flange support being seperated from said upper flanges by a pair of spaced thumb wheels having said threaded bolts both extending therethrough and secured thereto, rotation of each of said wheels selectively moving said spacers up and down with respect to said carrier to thereby clamp said each of said skates between each of said respective spacer and said flange.

5. In the carrier of claim 4 wherein a pair of spaced vertical portions interconnect said upper flanges with said flange support and including alignment means associated with each of both said spacers and said vertical portions for aligning said spacers during their up and down movement.

6. In the carrier of claim 5 wherein said alignment means includes vertical slots in said vertical portions and pins fixedly secured to said spacers movable in said slots.

7. In the carrier of claim 1 wherein said support member includes a first vertical portion forming said bottom portion, a second integral angled portion extending from said first vertical portion to a curved portion connected to a generally horizontal portion forming said upper handle portion.

* * * * *